US005590706A

United States Patent [19]

Tsou et al.

[11] Patent Number: 5,590,706

[45] **Date of Patent: *Jan. 7, 1997**

[54] ON-LINE FOULING MONITOR FOR SERVICE WATER SYSTEM HEAT EXCHANGERS

[75] Inventors: John L. Tsou, Foster City, Calif.; John F. Garey, Marion, Mass.

[73] Assignee: Electric Power Research Institute, Palo Alto, Calif.

[ * ] Notice: The term of this patent shall not extend beyond the expiration date of Pat. No. 4,429,178.

[21] Appl. No.: 497,959

[22] Filed: Jul. 3, 1995

Related U.S. Application Data

[63] Continuation-in-part of Ser. No. 165,750, Dec. 10, 1993, Pat. No. 5,429,178.

[51] Int. Cl.[6] ..... F28G 13/00

[52] U.S. Cl. ..... 165/11.1; 165/95; 165/DIG. 2

[58] Field of Search ..... 165/11.1, 95

[56] References Cited

U.S. PATENT DOCUMENTS

| | | | |
|---|---|---|---|
| 4,390,058 | 6/1983 | Otake et al. | 165/95 X |
| 4,476,917 | 10/1984 | Otake et al. | 165/95 X |
| 5,255,977 | 10/1993 | Eimer et al. | 165/11.1 X |
| 5,385,202 | 1/1995 | Drosdziok et al. | 165/11.1 X |
| 5,429,178 | 7/1995 | Garey et al. | 165/11.1 |

FOREIGN PATENT DOCUMENTS

| | | | |
|---|---|---|---|
| 47199 | 3/1982 | Japan | 165/11.1 |

OTHER PUBLICATIONS

J. L. Tsou, et al., "Condenser On–Line Fouling Monitor", Presented at the International Joint Power Generation Conference, ASME PWR–vol. 25, Phoenix, AZ (Oct. 1994), pp. 19–30.

J. L. Tsou, et al., "On–Line Condenser Fouling Monitor Development", Presented at the Nuclear Plant Performance Improvement Seminar, Charleston, SC(Aug. 1994.), pp. 195–211.

J. L. Tsou, "Power Plant Heat Exchanger Performance Prediction —A Simplified Method", ASME 84–JPGC–NE–14, Presented at the International Joint Power Generation Conference, Toronto, Ontario, Canada (Oct. 1984).

*Primary Examiner*—Leonard R. Leo
*Attorney, Agent, or Firm*—Thomas A. Kahrl, Esq.

[57] ABSTRACT

An electro-mechanical, dual tube and plug device for on-line monitoring of performance losses due to reduced conductivity of a non condensing heat exchanger resulting from micro-bio fouling of the surfaces of said heat exchanger and for detecting change of heat transfer resistance of individual heat transfer tubes. The dual tube and plug assembly includes a first flow assembly tube and a second temperature assembly tube attached to the discharge end of a heat exchanger for providing accurate measurement of temperature and cooling water flow. The first flow assembly tube includes a tube having an inner chamber, including a flow sensor a temperature sensor for measuring discharge water temperature. The second temperature assembly tube plugs the inlet and the outlet of a heat transfer tube immediately adjacent to the flow assembly tube and includes a plurality of temperature sensors in the plugged empty heat transfer tube. Flow and discharge temperature signals from a first dual tube device are combined with other flow and discharge temperature signals, from additional dual tube devices. These signals are sent to a micro-processor which, utilizing inlet water temperature data provided by an inlet temperature sensor, continuously calculates, records and displays the individual heat transfer tube heat transfer co-efficient.

10 Claims, 6 Drawing Sheets

ON-LINE FOULING MONITOR FOR SERVICE WATER SYSTEM HEAT EXCHANGERS

CROSS REFERENCE TO RELATED APPLICATIONS

This application is a continuation-in-part of U.S. patent application Ser. No. 08/165,750 filed Dec. 10, 1993, now U.S. Pat. No. 5,429,178, entitled Dual Tube Fouling Monitor and Method, the original application and of PCT patent application Ser. No. PCT/US94/14261, filed Dec. 12, 1994, entitled Dual Tube Fouling Monitor and Method which is incorporated herein by reference in it's entirety.

In the original application a heat exchanger fouling monitor is disclosed, as is shown in a general system schematic in FIG. 1 of this application, including a sensing instrument consisting of a dual tube and plug assembly installed on a heat exchanger configured as a condenser. As is set forth in the original application the sensing instrument may be mounted in selected heat exchange tubes of a heat exchanger tube sheet in any location or in multiple locations on the heat exchanger. Complete installation of the fouling monitor requires two adjacent tubes; the first tube being designated the "equilibrium" (dry) tube which is plugged and the second tube being designated as the "active" (monitored) tube is open. On the discharge side of the heat exchanger, the selected heat exchanger tubes are ground flush with a tube sheet. Small PVC mounting brackets are attached directly to said tube sheet to facilitate alignment and position the monitor relative to the condenser. Cables, which transmit instrument signals, are supported by small brackets on the tube sheet and waterbox, and exit through a small (1") hole at the top of the discharge waterbox. Wiring is connected to a microprocessor-based data acquisition system which continuously records the data at user selected intervals.

The principal component of the monitor assembly as shown in the original application is a dual tube system which is installed on the discharge side of the operating heat exchanger, shown as a condenser in the preferred embodiment (FIG. 2). Each tube in the dual tube and plug assembly is precisely machined to match the internal diameter of the heat transfer tubes in the heat exchanger and is positioned by means of a silicone expansion plug/fitting. The first "active" tube contains a flow sensor shown as a paddle wheel in the preferred embodiment, though other sensors may be employed including an ultrasonic flow meter, and a platinum resistance temperature detector (RTD) and remains open to permit flow of coolant. In operation of the condenser the installed flow sensors continuously measure the flow velocity (fps) and temperature sensor continuously monitor discharge water temperature (°F.).

The second "equilibrium" tube module is inserted in the heat transfer tube adjacent to the "active" tube. It contains a spring-loaded surface temperature RTD which is inserted in the heat transfer tube of the condenser. This RTD is used to measure the saturated steam temperature and due to the design of the system allows this temperature sensor to be located at any point where true isothermal steam temperature is exhibited. This second "equilibrium" module is connected through to a second platinum RTD located on the inlet side of the condenser shown in FIG. 3 of this application which measures the inlet water temperature (°F.). The "equilibrium" tube is then isolated on the inlet with a water tight seal. All signal cables pass through a small opening in the discharge waterbox and are connected to a microprocessor-based data acquisition system.

Measurement signals (4–10 mA) from the instrumented tube (inlet, discharge and saturated steam temperatures and flow velocity) are directly linked to a microprocessor based data acquisition system. Data is continuously recorded and stored at selected intervals; a specifically developed program enables the user to display individual values, as well as, the calculated heat transfer coefficient (U). Mathematically, this is calculated as:

$$U=Q/(A*LMTD) \tag{1}$$

These factors are determined from the directly measured values as:

$$Q = W * Cp * (Tout - Tin) \tag{2}$$

$$LMTD = \frac{(T_S - t_2) - (T_S - t_1)}{\ln \frac{(T_S - T_2)}{(T_S - T_1)}}$$

Since the system disclosed in the original application measures and records data continuously, the progression of performance degradation due to the isolated effects of fouling may be observed and quantified. The prototype of the original application was tested at New England Power Company Brayton Point Station as is shown in FIG. 4 of this application. Results for the measured heat transfer coefficient verse plant load is shown in FIG. 5.

BACKGROUND OF THE INVENTION

Field of the Invention (Technical field)

Biological and/or chemical fouling of heat exchangers in utility service water systems causing reduced heat transfer capability adversely affects operation and maintenance costs, and can force a power derating or even a plant shut down. In addition, service water heat exchanger performance is a safety issue for nuclear power plants, and the issue was highlighted by NRC in Generic Letter 89-13. Heat transfer losses due to fouling are difficult to measure and, usually, quantitative assessment of the impact of fouling is impossible. Plant operators typically measure inlet and outlet water temperatures and flow rates and then perform complex calculations for heat exchanger fouling resistance instrumentation.

BACKGROUND PRIOR ART

Applicant is aware of prior art sensing devices covered by U.S. Pat. No. 4,762,168 to Kawabe et al., discussed in the original application. Other prior art devices are covered by the following U.S. Patents: U.S. Pat. No. 3,477,289, WIEBE, Issued November 1969; U.S. Pat. No. 4,265,127, ONODA, Issued May 1981; U.S. Pat. No. 4,385,658, LEONARD, Issued May 1983; U.S. Pat. No. 4,390,058, OTAKE ET AL, Issued June 1983; U.S. Pat. No. 4,476,917, OTAKE ET AL, Issued October 1984; U.S. Pat. No. 4,644,787, BOUCHER ET AL, Issued February 1987; U.S. Pat. No. 4,766,553, KAYA ET AL, Issued August 1988; U.S. Pat. No. 5,083,438, McMULLIN, Issued January 1992; U.S. Pat. No. 5,255,977, EIMER ET AL, Issued October 1993; and U.S. Pat. No. 5,215,704, HIROTA, Issued June 1993.

Applicant is aware of additional prior art attempts at on-line monitoring which have been met with varying degrees of success, in particular a device disclosed by ESEERCO in 1987 previously discussed in the original application. Another device is disclosed by Czolkoss (Taprogge Inc.) as disclosed in 1990 uses another approach to on-line monitoring connected directly to an operating heat exchanger.

The problem not recognized by the prior art is that performance sensors fail to provide accuracy in directly measuring temperature and flow parameters in a heat exchanger while operating, because they interfere with the operation of the system, as installed, with the result that the parameters to be tested are altered. Heretofore such interference has been compensated for by values not directly measured, but computed, or given an assumed value.

The present invention has solved this problem in a novel fashion by providing internal temperature and internal flow instrument positioned in individual instrumented heat transfer tubes for use with an on-line service water fouling monitor which does not interfere with routine plant operations, including on-line mechanical and chemical treatment methods; and provides continuous, real-time readings of the heat transfer efficiency of a selected instrumented tube, and to overcome at least some of the disadvantages of the prior art heat exchanger performance devices and methods.

SUMMARY OF THE INVENTION

This invention relates to a heat exchanger fouling monitor for continuously monitoring heat transfer efficiency of individual heat transfer tubes of an operating service water heat exchanger and to a method incorporating a Heat Transfer Algorithm which provides accurate measurement and calculation of the combination of reduced conductivity of the heat exchanger resulting from scaling or micro-bio fouling to provide a continuous reading of the heat transfer coefficient determining any deterioration in the performance of the heat exchanger.

In particular the present invention is particularly adapted for performing on-line monitoring of service water heat exchangers in a nuclear power plant. The present invention involves a novel improved design of on-line fouling monitor for service water system employing shell side and tube side temperature sensors providing calculations for use with a Heat Transfer algorithm employed used to calculate service water heat exchanger fouling by directly reading the inlet and outlet water temperature on both shell side and tube side of the heat exchanger. In so doing, it is found desirable to provide a new and improved on-line monitoring device, algorithm and method whereby said the on-line monitoring device provides accurate measurement of reduced conductivity of the service water heat exchanger resulting from scaling or micro-bio fouling. In the present invention a cooling water flow sensor is provided in combination with the shell side and tube side temperature sensors wherein the on line monitor continually monitors the signals of the temperature and flow sensors to provide a continuous reading of the heat transfer co-efficient determining any deterioration in the performance of the heat exchanger.

Fouling can be more critical in nuclear power plants where it can reduce the heat transfer capability of safety-related heat exchangers. A recently published NRC Generic Letter [1] emphases the need to monitor performance of safety related heat exchangers. Recognizing the industry need, EPRI'S Nuclear Division Service Water Working Group (SWWG) developed the Heat Exchanger Performance Monitoring Guidelines, EPRI Report NP-7552 [2]. This report lists five heat exchanger performance monitoring methods:

a. Heat Transfer Method b. Temperature Monitoring Method c. Temperature Effectiveness Method d. Delta P Method e. Periodic Maintenance Method The Heat Transfer Method uses flow and both service water and process side temperature measurements to determine heat transfer rate and log mean temperature difference. These are used to calculate the overall heat transfer coefficient and the fouling resistance. It is the only method that directly determines heat transfer capability. The remaining four methods are indirect, involving simulation, extrapolation, correlation, and visual inspection, The guidelines also state that the Heat Transfer Method is the most difficult to instrument, test, and analyze.

Effective monitoring of fouling of a heat exchanger requires accurate measurement of individual heat transfer tubes with respect to quantity and velocity of the cooling water flow, as well as temperature differential at the inlet and discharge end of the heat exchanger. This permits the computation of thermal efficiency of the heat exchanger tube as a whole and that this thermal efficiency be continuously monitored and continuously displayed.

The algorithm programmed into the microprocessor disclosed in the original application will compute heat transfer resistance for each flow tube and plug tube set. The preferred method is based on the rearrangement of a common equation derived in many basic heat transfer texts, used for heat exchanger design as detailed below;

V=Coolant Flow Rate (M/sec) Each Tube $Q_H$=Heat Flux (watts)

$T_I$=Coolant Inlet Temperature (°C.)

$T_E$=Coolant Outlet Temperature (°C.)

$T_S$=Steam Temperature (°C.)

U=Heat Transfer Coefficient (watts/$M^2$-°C.)

$R_T$=Heat Transfer Resistance ($M^2$-°C./watts)

LMTD=Logarithmic Mean Temperature Difference $A_H$=Area, Heat Exchanger (Effective) ($M^2$)

$A_C$=Area, Tube Cross Section ($M^2$)

$C_P$=Specific Heat of Water (watts/°C.-Kg)

P=Density of Water (Kg/$M^3$)

M=Mass Flow of Coolant Water (Kg/sec)

$$Q_H = MC_P\,(T_E - T_I)$$

$$M = PVA_C$$

$$\therefore\ Q_H = PVA_C C_P\,(T_E - T_I);$$

also $$Q_H = UA_H\,(LMTD) = UA_H\left[\frac{(T_E - T_I)}{\ln\dfrac{(T_S - T_I)}{(T_S - T_E)}}\right]$$

$$\therefore\ PVA_C C_P\,(T_E - T_I) = UA_H\left[\frac{(T_E - T_I)}{\ln\dfrac{(T_S - T_I)}{(T_S - T_E)}}\right]$$

reorganizing yields: solving for $1/U=R_T$ by definition $$R_T = \frac{1}{U} = \frac{A_H\left[\dfrac{(T_E - T_I)}{\ln\dfrac{(T_S - T_I)}{(T_S - T_E)}}\right]}{PVA_C C_P\,(T_E - T_I)}$$

or $$R_T = (\text{CONSTANT})\left[\frac{\dfrac{(T_E - T_I)}{\ln\dfrac{(T_S - T_I)}{(T_S - T_E)}}}{V(T_E - T_I)}\right]$$

This calculation assumes that the heat exchanger is operating under steady state conditions and the tube area/heat exchanger area are constant. Further improvements in accuracy of calculation are possible by mathematically dividing the tube into differential elements and utilizing the algorithms as outlined above.

Initial conditions are measured with clean heat transfer tubes to establish a reference $R_T$. With use, $R_T$ will increase and when it reaches a predetermined value, due to the buildup of scale etc., it indicates a need for maintenance services, such as cleaning the internal surfaces of the heat transfer tubes.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 2:
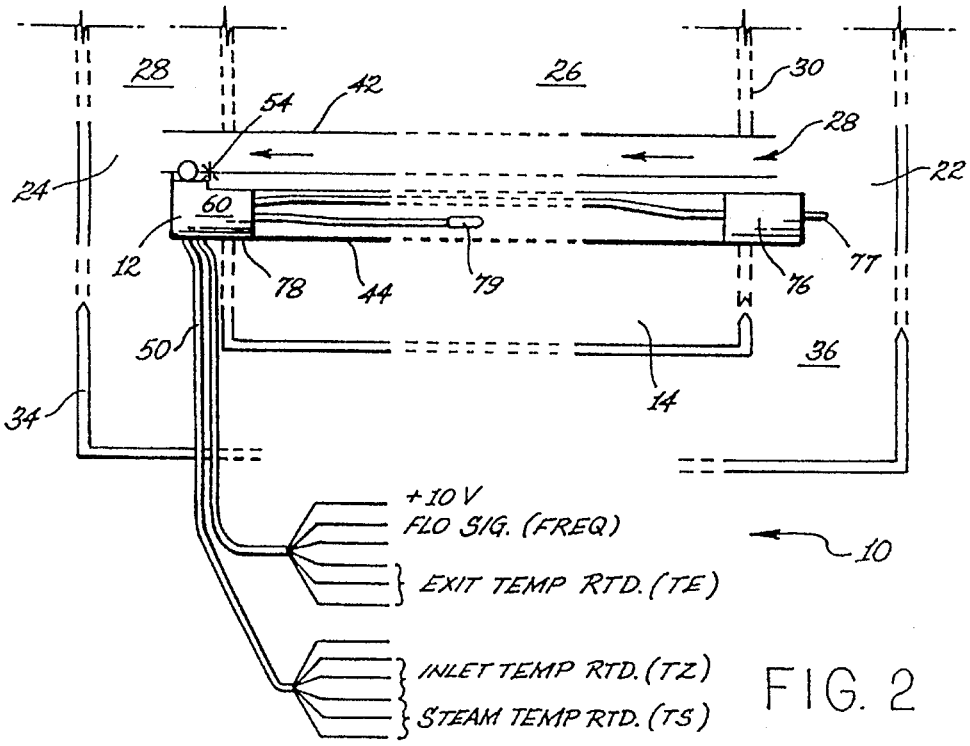
FIG. 2 is a schematic view showing a heat exchanger equipped with a dual tube fouling monitor according to the original application of FIG. 1.

Referring to FIGS.(1–7) there is shown a fouling monitoring system 10 including a dual tube and plug sensing device 12 mounted on a heat exchanger 14 and connected to a monitoring apparatus 16 including a microcomputer 18 and a display monitor 20. The heat exchanger 14 as is shown in FIG. 2 includes an inlet header 22 at the inlet end spaced from an discharge header 24 at the outlet end and includes a steam zone 26 and a coolant fluid zone 28. In the original prior embodiment coolant fluid 36 typically is sea water.

Figure 1:
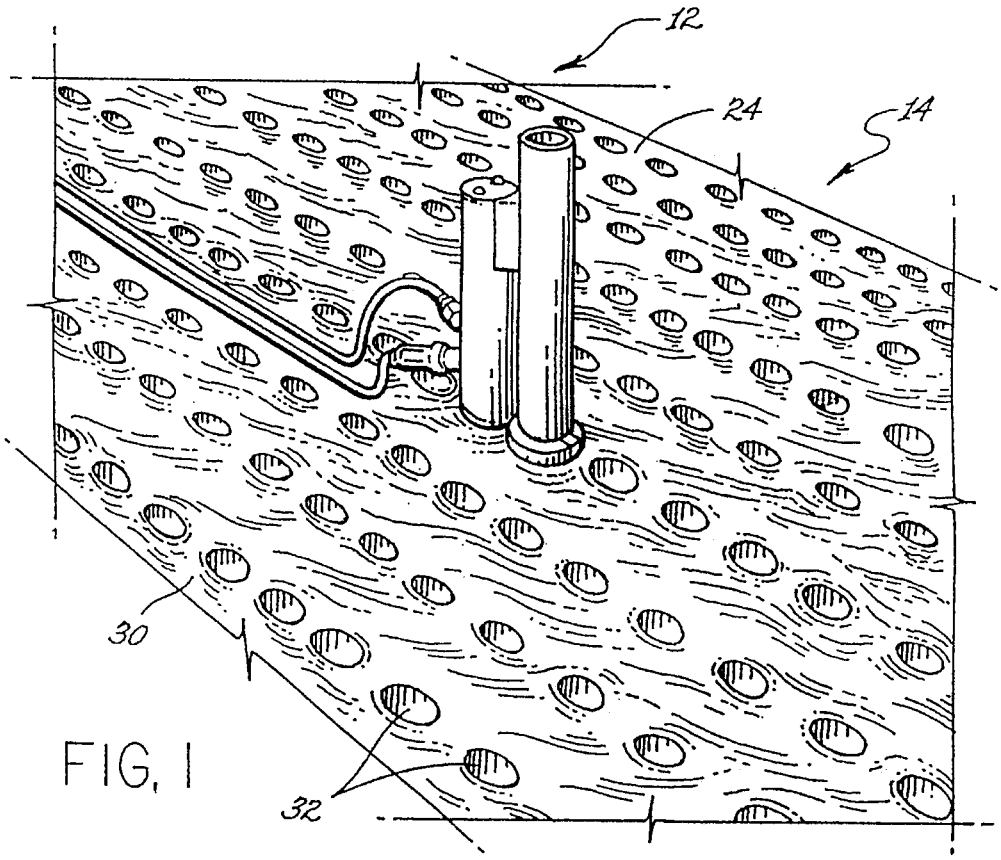
FIG. 1 is a perspective view from above showing a heat exchanger configured as a condenser equipped with a dual tube fouling monitor according to the invention of the original invention.
Figure 3:
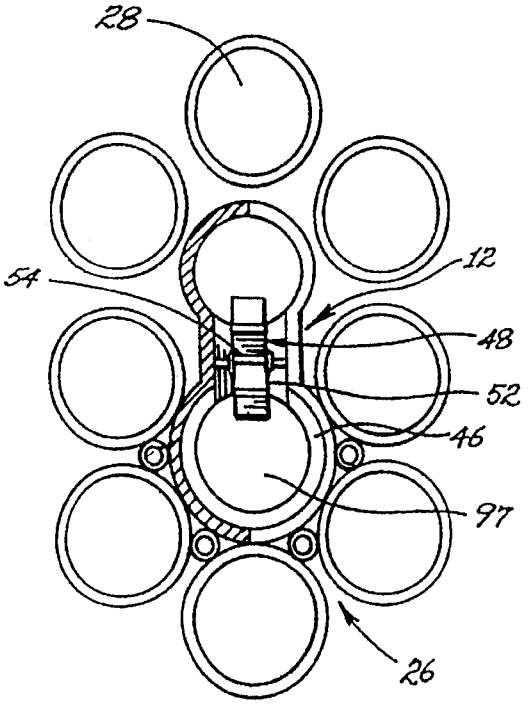
FIG. 3 is an end view arrangement of the dual tube fouling monitor of the invention of FIG. 1 attached to a tube sheet.

In the original prior embodiment, the heat exchanger 14 includes a tube sheet 30 shown in FIG. 1 forming a heat exchange surface between the coolant fluid 36 and the steam entering the heat exchanger 14 consisting of a plurality of individual heat transfer tubes 32 extending longitudinally between the inlet header 22, for separately introducing exhaust steam and the coolant fluid 36 into the heat exchanger 14 and the discharge header 24 at the outlet end 34. The dual tube and plug sensing apparatus 12 is mounted at the discharge end of a flow monitoring tube 42 and an adjacent temperature monitoring tube 44 as is shown in FIG. 2 & 3. The dual tube and plug sensing apparatus 12 consists of a flow assembly tube 46 positioned in coaxial relationship with the flow monitoring tube 42 at the discharge end and includes a flow sensor 48 electrically operated and attached to conduit means 50 mounted in an inner chamber 52 extending perpendicularly with said flow assembly tube 46 and including a rotable paddle wheel 54. Said paddle wheel 54 is positioned in association with a wheel sensor 56 connected electrically by conduit 50 to the fouling monitoring system 10, wherein said paddle wheel 50 extends into the tubular conduit 58 of the flow assembly tube 46 adapted for guiding coolant fluid 36 to be measured for directly measuring the coolant flow through said tubular conduit. Said dual tube and plug sensing device 12 includes a plug device 60 adapted for attachment to the discharge end of the temperature monitoring tube 44.

The display monitor 20 is connected to the microprocessor and then, by conduit 50, to one or more of the dual tube and plug sensing devices 12 and is for displaying the system operating conditions. The micro-processor 80 is continuously calculating, recording, and displaying the individual heat exchanger tube heat transfer coefficient and flow index on a display panel 82. A mounting collar 84 is provided for supporting the dual tube and plug sensing apparatus 12 at the discharge end of tube sheet 30.

As is shown in FIG. 2, there is positioned, a discharge temperature sensor 81, in the same chamber as the flow sensor 48, typically a platinum RTD is positioned for measuring discharge water temperature. An inlet plug 76 an a discharge plug 78 are provided to plug the temperature monitoring tube adjacent to the flow sensor tube. Also a spring loaded RTD sensor 79 positioned in the steam sensor tube to monitor saturated steam temperature is positioned in the closed temperature monitoring tube 44. The steam temperature signal transmitted by the sensor 79 is returned through a water tight fitting 90 through the dual tube and plug sensing apparatus 12 where it is processed with other flow and discharge temperature signals by the microprocessor 18. Signals from the dual tube and plug sensing apparatus 12 pass out of the discharge waterbox 92 to the micro-processor 80 via a first branch adaptor 94 and a second branch adaptor 96 for use in providing a conduit for the electrical connectors 50 by providing a water tight branch aperture 93.

Figure 4:
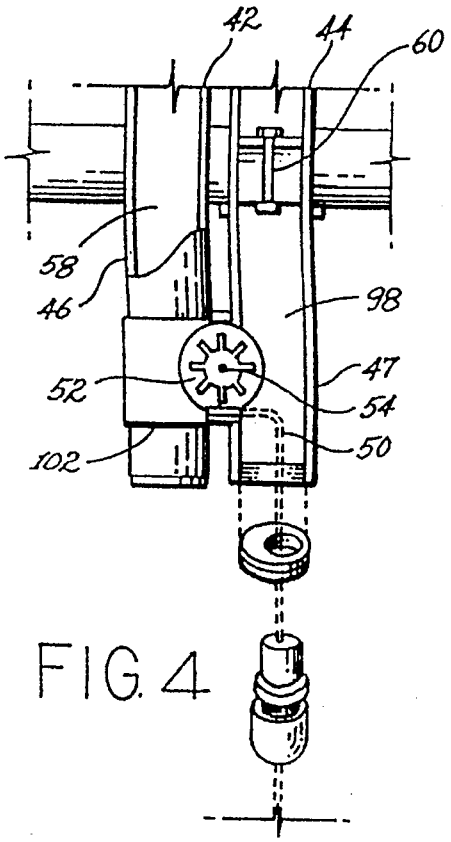
FIG. 4 is a schematic side view showing the dual tube fouling monitor partially cut away of the invention of FIG. 1.
Figure 5:
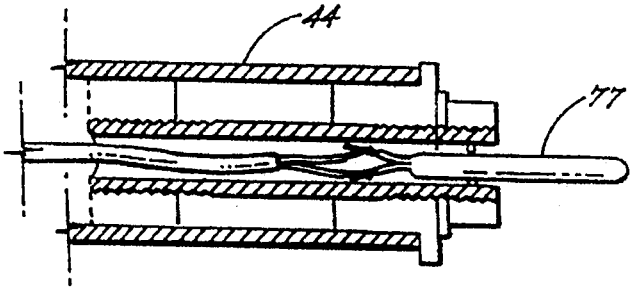
FIG. 5 is a schematic side view showing the dual tube fouling monitor partially cut away to show the inlet temperature probe of the invention of FIG. 1.
Figure 6:
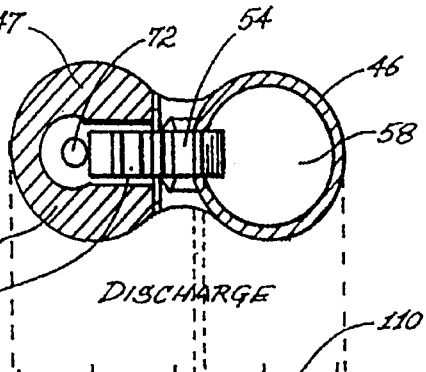
FIG. 6 is an end view arrangement of the dual tube fouling monitor in section taken along lines 8—8 of FIG. 9 of the invention of FIG. 1 attached to a heat transfer tube sheet.
Figure 7:
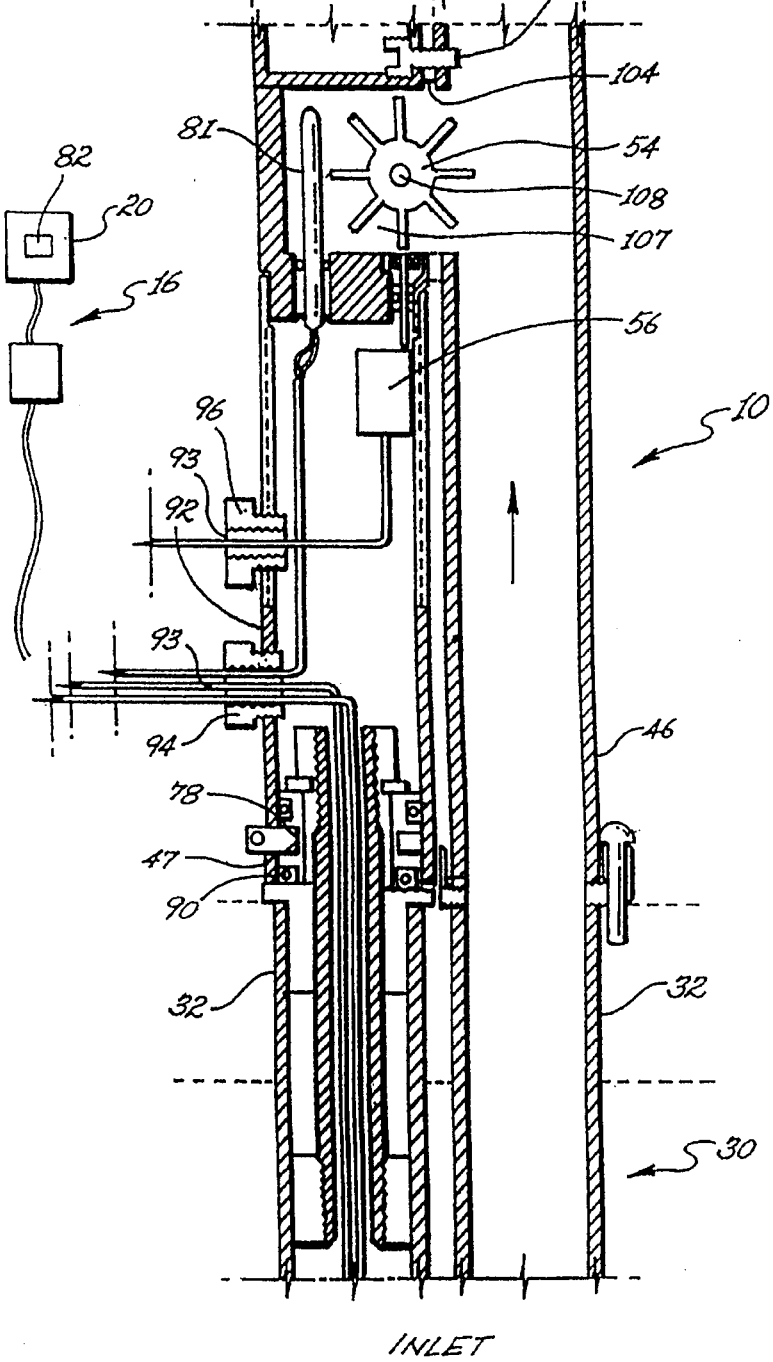
FIG. 7 a is a sectional side view showing a dual tube fouling monitor system installed on a heat exchanger incorporating the dual tube fouling monitor according to the invention of FIG. 1.

As is shown in FIG. 4 the flow assembly tube 46 is characterized by a first open tubular conduit 58 for guiding coolant fluid 36 to be measured and the temperature assembly tube 47 is characterized by a second enclosed tubular conduit 98 for sensing saturated steam temperature with thermal sensors 72 disposed within said first and second enclosed tubular conduit connected by electrical conduit 50 connecting the thermal sensors 72, including inlet sensor 77 and 79 to a circuit for sending signals to a micro-processor 100. A branch adapter assembly 102 connects the first open tubular conduit 58 to the second enclosed tubular conduit 98 wherein each of said first and second tubular conduits have a convex external surface with a branch aperture 104, shown in FIG. 9 formed therein including an associated branch hole formed therein comprising an elongated member defining a body part 106 including a paddle wheel chamber 107 and an axle part 108 for supporting the paddle wheel 54 having a central aperture axially formed there through to permit communication with said paddle wheel, said paddle wheel chamber having the first connecting part in an opposite second connecting part and including sealing means 110 for sealing said body parts against said convex external surface of said first and second flow conduit.

Figure 9:
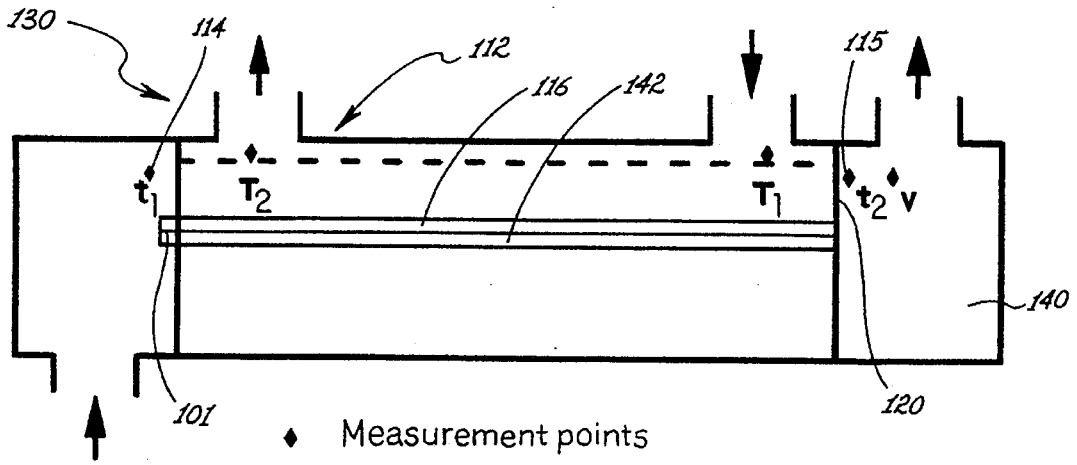
FIG. 9 is a schematic side view of the current invention showing a single-pass shell and tube heat exchanger with shell side connections on the same side according to the present invention of on-line monitor for service water system heat exchangers.
Figure 10:
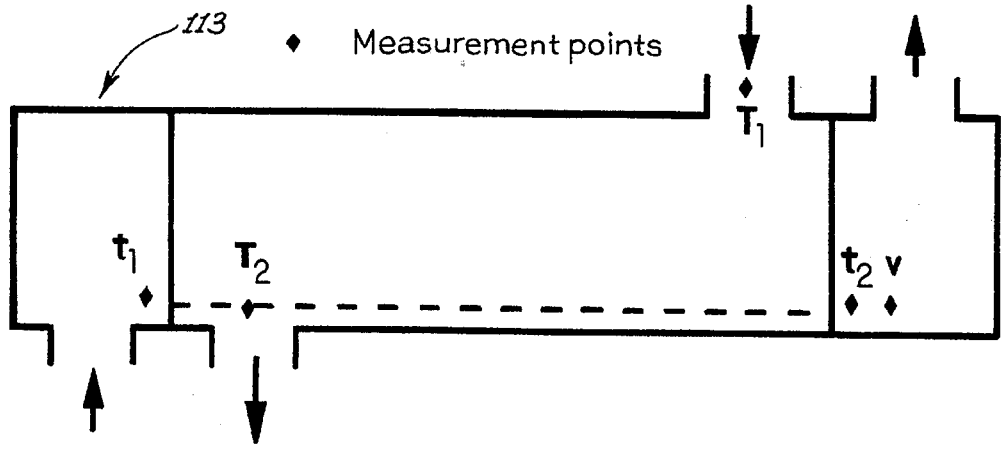
FIG. 10 is a schematic view side showing a single-pass shell and tube heat exchanger with shell side connections on the opposite side according to the invention of FIG. 9.
Figure 11A:
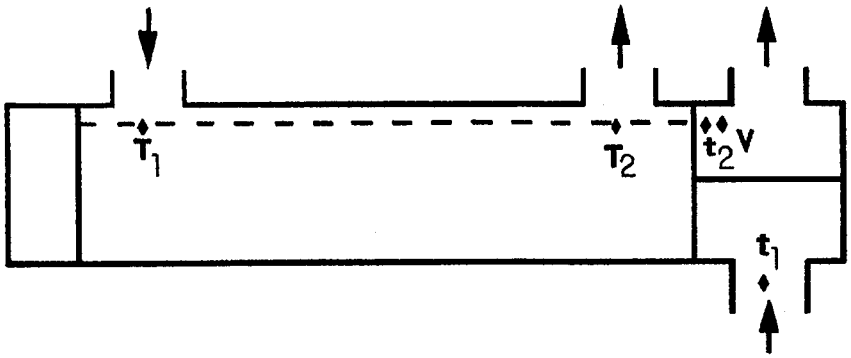
FIG. 11*a*, 11*b*, 11*c* & 11*d* are possible arrangements for two-pass Tube exchangers according to the invention of FIG. 9.
Figure 11B:
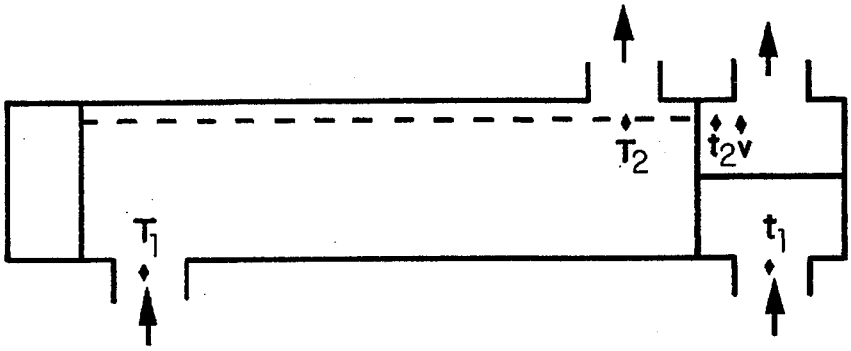
Figure 11C:
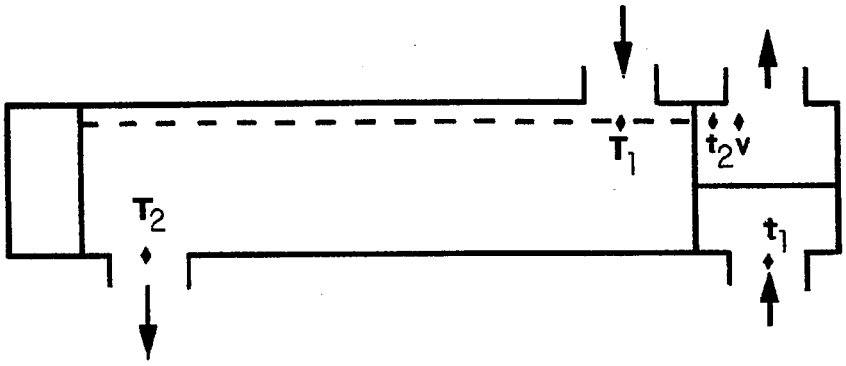
Figure 11D:
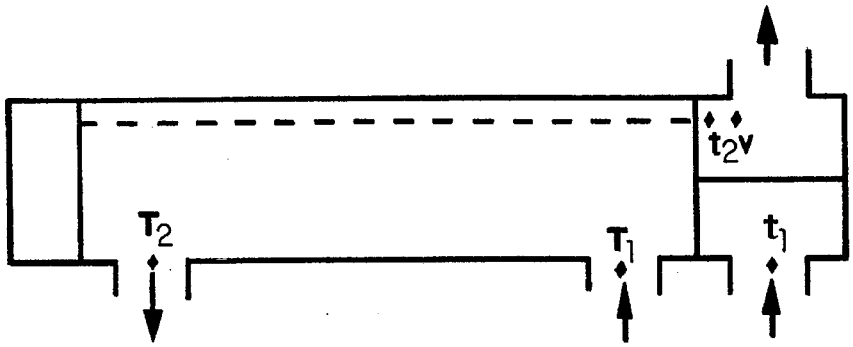

In the current preferred embodiment as is shown in FIGS. 9–10) there is shown an on-line fouling monitor 101 for use with a non condensing heat exchanger 112 in a service water system having two RTD's 114 & 115 installed in dry tube 116 in a liquid to liquid application. In this type of application the sensible heat transfer takes place on the shell side of the heat exchanger therefore both inlet and outlet temperature need to be measured. One of the RTD's 114 will be used to measure the shell side inlet water temperature and the other RTD 115 will be used to measure the shell side outlet water temperature. Tube 116 positioned in the top row 124 of the heat exchanger 112 will be selected as the dry tube for measuring true inlet and outlet water temperatures.

The preferred embodiment comprises a system 130 shown in FIGS. 9 & 10 as shown and described will measure inlet and outlet water temperatures on both shell side and tube side (FIG. 9). The system 130 will also measure the velocity of cooling water 140 through one tube 142. With these data, it is possible to conduct performance monitoring using the Heat Transfer Method, If the shell side connections are not the same side of the heat exchangers (FIG. 10), it may be necessary to measure the shell inlet temperature with a separate RTD.

| Nomenclature | |
|---|---|
| A | Total surface area ($ft^2$) |
| a | Internal flow area of one tube ($in^2$) |
| CLMTD | Corrected log mean temperature difference (F) |
| $C_p$ | Specific heat for shell side fluid (btu/lb/F) |
| $C_p$ | Specific heat for tube side fluid (btu/lb/F) |
| $F_{1-2}$ | Log mean temperature correction factor |
| LMTD | Log mean temperature difference (F) |
| n | Number of tubes per pass |
| P | See equation 10 |
| Q | Total Heat flux (btu/hr) |
| $q_1$ | Heat flux for one tube (btu/hr) |
| R | See equation 11 |
| $R_f$ | Fouling Resistance (hr-$ft^2$-F/btu) |
| T | Shell side temperature |
| t | Tube side temperature |
| $U_m$ | Measured Overall heat transfer coefficient (btu/hr/$ft^2$/F) |
| $U_c$ | Clean overall heat transfer coefficient (btu/hr/$ft^2$/F) |
| v | Velocity (ft/sec) |
| W | Shell side flow rate (lb/hr) |
| w | Tube side flow rate (lb/hr) |
| $w_1$ | Tube side flow rate for one tube (lb/hr) |
| p | Density of tube side fluid (lb/$ft^3$) |
| Subscripts | |
| 1 | Inlet |
| 2 | Outlet |
| s | Steam |

The calculation procedure for shell and tube heat exchanger with single-pass shell and tube side and arranged in counter flow (the most common arrangement) are:

1. Calculate flow rate for one tube,
   $w_1=25*p*v*a$
2. Calculate heat exchanged for one tube,
   $q_1=w_1c_p(t_2-t_1)$
3. Calculate total tube side flow,
   $w=n*w_1$
4. Calculate total heat exchanged,
   $Q=n*q_1$
5. Calculate shell side flow, $$W=\frac{Q}{C_P(t_1-T_2)}$$

6. Calculate log mean temperature difference (LMTD), $$LMTD=\frac{(T_1-t_2)-(T_2-t_1)}{\ln\frac{T_1-t_2}{T_2-t_1}}$$

7. Calculate measured overall heat transfer coefficient, $$U_m=\frac{Q}{A*LMTD}$$

8. Calculate fouling resistance, $$R_f=\frac{1}{U_m}-\frac{1}{U_c}$$

If the measured overall heat transfer coefficient is not at design, it can be corrected to the design condition based on the shell side and tube side flow rates and temperatures. This information can be used to predict performance of the heat exchanger under any other operating conditions. The calculation procedures are outlined in reference 2.

Calculation for Heat Exchanger with Two or Four Tube Passes

Figure 8:
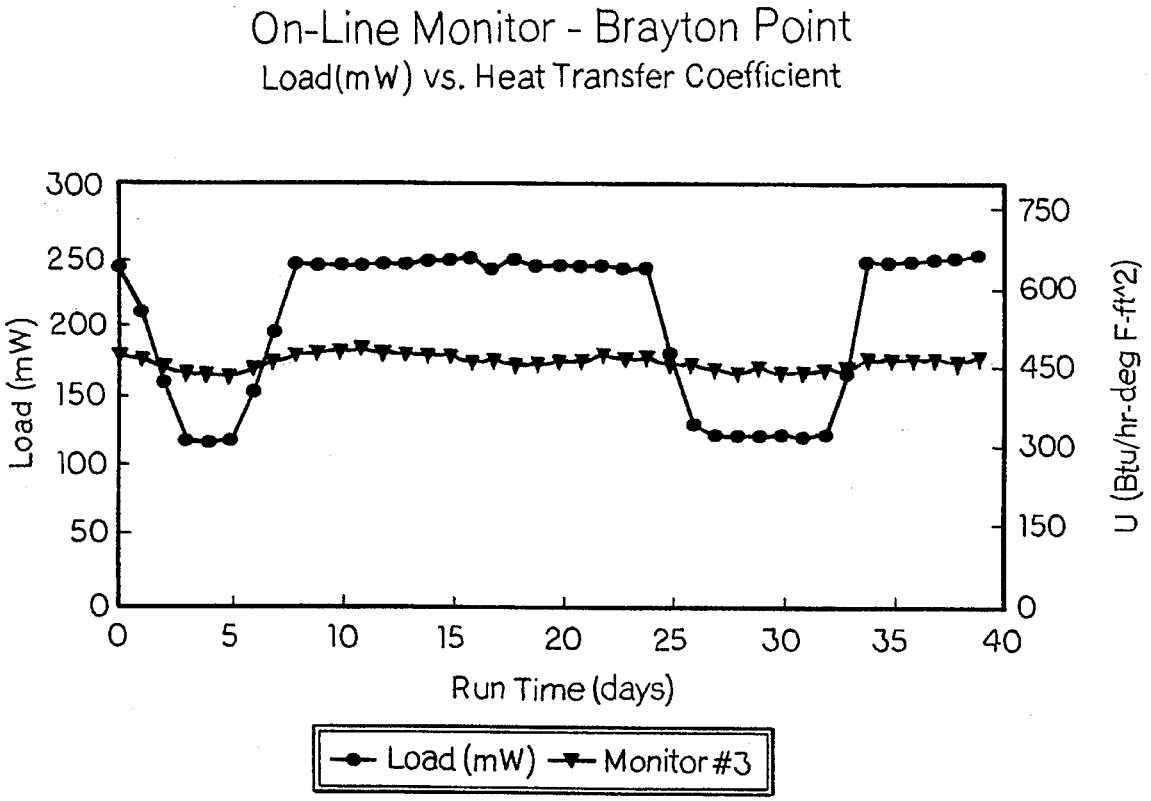
FIG. 8 is a graphical illustration of Load vs. Heat Transfer Coefficient.

Depending on the tubeside and shell side connection arrangements, the instrument may be placed on inlet side or outlet side of cooling water. Schematic of the connection arrangements and instrument placement are illustrated in FIG. 8. The calculation procedures are similar to the single-pass heat exchanger with the exception that the corrected log mean temperature (CLMTD) are to be used. The correction procedure is as follows [6]:

$$P=\frac{(t_2-t_1)}{(T_1-t_1)}$$

$$R=\frac{(T_1-T_2)}{(t_2-t_1)}$$

$$F_{1-2}=\frac{\frac{\sqrt{R^2+1}}{R-1}\log_{10}\frac{1-P}{1-PR}}{\log_{10}\frac{(2/P)-1-R+\sqrt{R^2+1}}{(2/P)-1-R+\sqrt{R^2+1}}}$$

$$CLMTD=F_{1-2}*LMTD$$

$$U=\frac{Q}{A*CLMTD}$$

The on-line fouling monitor for service water system heat exchangers of the preferred embodiment has the following advantages:

a. Provides fouling data under operating conditions
b. Minimum disturbance of the process condition
c. No water box penetration other than wiring
d. No interference with routine operations e. Precise and direct measurement of inlet and discharge temperature on both side f. Accurate measurement of flow rate g. Accurate calculation of heat load h. Continuous, real time data acquisition for accurate forecasting and trending

What is claimed is:

1. A sensing apparatus adapted for use with a heat exchanger for use with a service water system comprising:

a) heat exchanger means having a shell side and a tube side comprising;

i) tube sheet means for providing a heat exchange surface between a coolant fluid zone and service water zone comprising a plurality of individual heat transfer tubes extending between an inlet header configured for separately introducing service water and coolant fluid into said heat exchanger means, and a discharge header configured for separately extracting exhaust service water and coolant fluid from said heat exchanger means; said tube sheet means comprising:

ii) tube means for monitoring flow including at least one heat transfer tube providing a fluid flow conduit; and iii) tube means for monitoring temperature including at least one plugged heat transfer tube positioned immediately adjacent said means for monitoring flow;

b) combination means for individually sensing flow in said fluid flow conduit in combination with sensing temperature differentials in said plugged heat transfer tube, said combination means comprising a dual tube and plug apparatus connected to a discharge end of said tube means for monitoring flow adjacent said discharge header means and a discharge end of said tube means for monitoring temperature also adjacent said discharge header means, said dual tube and plug apparatus comprising:

i) a flow sensing device including a first flow assembly tube including a tubular conduit, and a flow sensor mounted in an inner chamber for directly measuring the coolant flow through the dual tube and a plug attachment for connection with the temperature monitoring tube;

ii) a second temperature assembly tube configured to plug the outlet of the temperature monitoring tube, for excluding coolant flow, immediately adjacent to the first flow assembly tube; and iii) means for detecting shell side inlet water temperature and shell side outlet water temperature;

iv) means for detecting tube side inlet water temperature and tube side outlet water temperature;

d) means for sealing out coolant flow comprising at least one plug devices for attachment to the inlet end of the temperature monitoring tube;

e) monitor means for comparing temperature differential signals and flow signals from the dual tube probe and plug means first dual tube probe and plug assembly and for combining other flow and discharge temperature signals from additional dual tube devices connected to a microprocessor; and f) microprocessor means for utilizing flow and temperature differential data provided by the flow sensor means and the temperature sensor means and continuously calculates, records and displays the individual tube heat transfer coefficient and flow velocity for the selected heat transfer tube.

2. The sensing apparatus of claim 1 wherein the heat exchanger comprises a shell and tube heat exchanger with single-pass shell and tube side wherein the microprocessor means continuously calculates, records and displays the individual tube heat transfer coefficient and flow velocity for the selected heat transfer tube calculated by the formula;

1) Calculate flow rate for one tube, $w_1=25*p*v*a$

2) Calculate heat exchanged for one tube, $q_1=w_1c_p(t_2-t_1)$

3) Calculate total tube side flow, $w=n*w_1$

4) Calculate total heat exchanged, $Q=n*q_1$

5) Calculate shell side flow, $$W=\frac{Q}{C_p(t_1-T_2)}$$

6) Calculate log mean temperature difference (LMTD), $$LMTD=\frac{(T_1-t_2)-(T_2-t_1)}{\ln\frac{T_1-t_2}{T_2-t_1}}$$

7) Calculate measured overall heat transfer coefficient, $$U_m=\frac{Q}{A*LMTD}$$

8) Calculate fouling resistance, $$R_f=\frac{1}{U_m}-\frac{1}{U_c}.$$

3. The sensing apparatus of clam 2 wherein the heat exchanger comprises a shell and tube heat exchanger with two or four tube passes wherein the microprocessor means continuously calculates, records and displays the individual tube heat transfer coefficient and flow velocity for the selected heat transfer tube calculated by the formula of claim 2 with the correction procedure as follows;

$$P=\frac{(t_2-t_1)}{(T_1-t_1)}$$

$$R=\frac{(T_1-T_2)}{(t_2-t_1)}$$

$$F_{1-2}=\frac{\frac{\sqrt{R^2+1}}{R-1}\log_{10}\frac{1-P}{1-PR}}{\log_{10}\frac{(2/P)-1-R+\sqrt{R^2+1}}{(2/P)-1-R+\sqrt{R^2+1}}}$$

$$CLMTD=F_{1-2}*LMTD$$

$$U=\frac{Q}{A*CLMTD}$$

4. The sensing apparatus of claim 1 wherein the first flow assembly tube comprises a tube having an inner chamber, including a flow sensor comprising an ultrasonic flow meter.

5. The sensing apparatus of claim 1 wherein means for detecting shell side inlet water temperature and shell side outlet water temperature comprises a first sensor and a second sensor in the plugged empty heat transfer tube which has been plugged and is therefor empty of coolant fluid.

6. The sensing apparatus of claim 1 wherein said plug assembly comprises:

i) a first flow assembly tube;

ii) a second temperature assembly tube; and iii) a temperature sensor for measuring discharge water temperature by means of at least two sensors.

7. The sensing apparatus of claim 1 wherein a plurality dual tube and plug assemblies are utilized for monitoring within a heat exchanger shell, whereby electronic signals from of said assemblies are multi-plexed to an external microprocessor for processing and display.

8. A combination sensing apparatus adapted for on-line monitoring of performance losses of a heat exchanger with respect to temperature and flow due to fouling of surfaces of said heat exchanger/heat exchanger comprising:

a) heat exchanger apparatus comprising:

i) a tube sheet having a plurality of heat transfer tubes;

ii) an inlet header apparatus; and iii) a discharge apparatus;

b) a plurality of dual tube and plug assemblies, each having a flow assembly tube and a temperature assembly tube wherein the flow assembly tube comprises a flow sensor for accurately measuring cooling water flow and a plug device for an attachment to a discharge end of the tube sheet, for measuring discharge water temperature; and the temperature assembly tube comprises a plurality of temperature sensors for detecting change of heat transfer resistance of a selected heat transfer tube comprising a pair of spaced apart probes;

c) monitor means for comparing flow and discharge temperature signals from a selected first dual-tube device and for combining other flow and discharge temperature signals, from additional dual tube devices and connected to a microprocessor; and d) micro-processor means for utilizing inlet water temperature data provided by an inlet temperature sensor, for continuously calculating, recording and displaying the individual heat transfer tube heat transfer co-efficient employing the formula 1) Calculate flow rate for one tube, $w_1=25*p*v*a$ 2) Calculate heat exchanged for one tube, $q_1=w_1c_p(t_2-t_1)$ 3) Calculate total tube side flow, $w=n*w_1$ 4) Calculate total heat exchanged, $Q=n*q_1$ 5) Calculate shell side flow, $$W=\frac{Q}{C_P(t_1-T_2)}$$

6) Calculate log mean temperature difference (LMTD), $$LMTD=\frac{(T_1-t_2)-(T_2-t_1)}{\ln\frac{T_1-t_2}{T_2-t_1}}$$

7) Calculate measured overall heat transfer coefficient, $$U_m=\frac{Q}{A*LMTD}$$

8) Calculate fouling resistance, $$R_f=\frac{1}{U_m}-\frac{1}{U_c}.$$

9. A method of monitoring fouling of inner surfaces of heat transfer tubes of a service water heat exchanger including a method to accurately measure change in heat transfer of the service water heat exchanger system as measured by change in heat transfer of actual individual heat transfer tubes within a heat exchanger while the heat exchanger is operational, comprising the steps of:

a) providing a probe assembly without altering operating characteristics of said operating heat exchanger including:

i) providing temperature sensor devices adapted for measuring efficiency of a heat exchanger which includes a plurality of temperature sensors;

ii) providing flow sensor devices; and iii) providing a calculator for generating a signal representing the efficiency of the heat exchanger as reflected by change in conductivity of heat transfer tubes as computed by the formula;

$$Q=U_TA\ (T_{STEAM}-T_{WATER})$$

$$Q=MC_P\ (T_{WATEROUT}-T_{WATERIN})$$

$$\therefore R_T\propto\frac{(T_{STEAM}-T_{WATERLOCALTEMP})}{\text{VELOCITYWATER}(T_{WATEROUT}-T_{WATERIN})}$$

b) detecting changes in heat transfer resistance of heat transfer tubes and a flow sensor for accurately measuring cooling water flow consisting of sensors attached to the discharge end of the heat exchanger and to a paddle wheel sensing device;

c) combining flow and discharge temperature signals from a first dual-tube device, and combined with other flow and discharge temperature signals, from additional remotely spaced dual tube devices and comparing with clean conditions base line data; and d) transmitting flow and temperature signals are sent to a micro-processor which, utilizing inlet water temperature data provided by an inlet temperature sensors, continuously calculates, records and displays the individual heat transfer tube heat transfer co-efficient.

10. The method of claim 9 wherein any number of probe assemblies are monitored within a heat exchanger shell, whereby electronic signals from each probe assembly are multi-plexed to a external micro-processor and wherein performance sensors achieve desired accuracy in directly measuring temperature and flow parameters in a heat exchanger while operating without interfering with operation of the system with the result that the parameters to be tested are not altered by providing internal temperature and internal flow sensors and without altering operating characteristics of the system being monitored wherein an on-line monitor continually monitors signals of temperature and flow sensor to provide a continuous reading of heat transfer co-efficient determining and deterioration in the performance of the heat exchanger.

* * * * *